US006293878B1

(12) United States Patent
Iwatsubo et al.

(10) Patent No.: US 6,293,878 B1
(45) Date of Patent: Sep. 25, 2001

(54) TENNIS RACKET WITH VIBRATION DAMPING MEMBER

(75) Inventors: Takuzo Iwatsubo; Yumi Kanemitsu, both of Hyogo (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 09/451,101

(22) Filed: Nov. 30, 1999

(30) Foreign Application Priority Data

Nov. 30, 1998 (JP) ..... 10-340836

(51) Int. Cl.[7] ..... A63B 49/02
(52) U.S. Cl. ..... 473/521; 473/524
(58) Field of Search ..... 473/519, 520, 473/521, 524, 537, FOR 171

(56) References Cited

U.S. PATENT DOCUMENTS 3,913,911 * 10/1975 Peterson ..... 473/519
3,941,380 3/1976 Lacoste .
4,139,194 * 2/1979 Fischer ..... 473/521
4,353,551 * 10/1982 Arieh et al. ..... 473/521
4,693,474 * 9/1987 Glaessgen et al. ..... 473/519
4,720,106 * 1/1988 Bickham ..... 473/521
5,054,780 * 10/1991 Chen ..... 473/519
5,165,687 * 11/1992 Soong ..... 473/521
5,374,057 * 12/1994 Lai et al. ..... 473/521

FOREIGN PATENT DOCUMENTS 52156031 12/1977 (JP) .
424263876 9/1992 (JP) .

* cited by examiner

*Primary Examiner*—Raleigh W. Chiu

(57) ABSTRACT

A tennis racket including a vibration damping member located in the vicinity of a position of a racket frame at which a large amplitude is generated when the tennis racket hits a tennis ball. The vibration damping member includes a mass adding part, such as a bracket assembly, having a portion extending in a widthwise direction of the tennis racket and a portion extending in a thickness direction thereof such that both portions are either integral or unintegral with each other; a viscoelastic material; a spring; or/and a damper each for connecting the mass adding part to the racket frame. The vibration damping member absorbs a vibration in an in-plane and an out-of-plane direction of the racket frame, and longitudinal and rotational impacts to be applied to a handle portion of the tennis racket.

17 Claims, 9 Drawing Sheets

(IN-PLANE FREQUENCY)

(OUT-OF-PLANE
SECONDARY FREQUENCY)

(OUT-OF-PLANE
PRIMARY FREQUENCY)

TENNIS RACKET WITH VIBRATION DAMPING MEMBER

FIELD OF THE INVENTION

The present invention relates to a tennis racket. More particularly, the present invention relates to a tennis racket having improved impact absorbing performance and vibration damping performance so that when a player hits a tennis ball with the tennis racket, an impact is applied to the player's elbow to a lesser extent in order to reduce generation of tennis elbow. The present invention relates also to a tennis racket which rotates on its grip to in a lesser extent to allow a player suffering from the tennis elbow to use it more easily.

DESCRIPTION OF THE RELATED ART

To reduce and soften a impact and a vibration of a tennis racket which is generated when a player hits a tennis ball therewith, vibration damping members are proposed as disclosed in Examined Patent Publication No. 52-13455 and Patent Application Laid-Open Nos. 52-156031 and 4-263876. In these proposals, a tennis racket is provided with a vibration damping member having a cantilever type damper to which a load material is fixed through an elastic material. The vibration of the tennis racket is damped by the vibration damping member which resonates with the vibration of the tennis racket. More specifically, in Examined Patent Publication No. 52-13455, as shown in FIG. 13, the cantilever type damper 6 formed of an elastic material is installed on the end of the grip 5. The rear end of the steel wire 6*b* having the weight 6*a* installed at the front end thereof is embedded in the frame. In Patent Application Laid-Open No. 52-156031, as shown in FIG. 14, the base part 3*a* of the damper is fixed to the throat part 4 of a tennis racket, and the body part 3*c* thereof is connected with the base part 3*a* through the neck part 3*b* to vibrate the body part 3*c*. In Patent Application Laid-Open No. 4-263876, as shown in FIG. 15, the loading member 4*b* is fixed to the grip end of a tennis racket through the elastic member 4*a*.

In the above-described conventional tennis rackets, the shape of the vibration damping member and the fixing position thereof are set to damp a primary vibration in an out-of-plane direction of the tennis racket (direction perpendicular to the gut-stretched plane of tennis racket, namely, thickness direction thereof). That is, the load material is fixed to the front end of one elastic material whose one end is fixed to the racket frame. In this construction, the elastic material and the load material vibrate in the out-of-plane direction before the racket frame vibrates, thus consuming vibration energy. That is, the elastic material and the load material suppress and damp the vibration and impact of the racket frame rapidly.

However, a player also feels vibrations in an in-plane direction (direction parallel with gut-stretched plane and widthwise direction of racket frame) as well as the out-of-plane direction vibration. When the player hits a ball with the tennis racket at a point thereof other than the axis of the racket frame, an impact generated by a rotation of the grip thereof makes the player feel very uncomfortable.

As shown in FIG. 16(A), in the out-of-plane direction vibration of the entire racket frame, a large mountain M1 is generated over the whole length of the tennis racket in its lengthwise direction. The apex (position of maximum amplitude) of the mountain M1 is located at approximately the center P1 of the tennis racket in its lengthwise direction. Supposing that a face part S is regarded as a clock and its top is 12 o'clock, the center P1 is located a region from five o'clock of a gut-installing part 1 surrounding the face part S to a throat part. The gut-installing part 1 of the racket frame surrounding the face part S is deformed lengthwise and widthwise by the in-plane direction vibration, as shown in FIG. 16(B). In the vibration, a maximum vibration occurs at the position of 12 o'clock (top position) and three o'clock of the gut-installing part 1.

The position of a maximum amplitude of the out-of-plane primary vibration is located in the region from the position of five o'clock of the gut-installing part 1 to the throat part. The position of a maximum amplitude of the out-of-plane secondary vibration is located at the position of three o'clock of the gut-installing part 1 and a region of the grip in the vicinity of the throat part.

The in-plane direction vibration of the tennis racket has not been considered much hitherto. The in-plane direction vibration of the gut-installing part is generated by deformation of the gut strings with which a ball collides and has a great influence on a player's feeling, namely, on whether or not the player feels comfortable when the player hits a tennis ball. For example, a so-called large racket developed flight performance, having a large area in its face (gut) generates uncomfortable vibrations, more so than a tennis racket having a small face area. This is because the large face area thereof to gut strings and head portion of the former causes the be easily flexed in the in-plane direction. More specifically, the head portion former vibrates in the in-plane direction to a high extent. Accordingly, in the so-called large racket and a so-called thick racket developed flight performance, it is important to suppress vibrations in the in-plane direction as well as in the out-of-plane direction.

SUMMARY OF THE INVENTION

The present invention has been made in view of the above-described problem. Thus, it is an object of the present invention to suppress vibrations of a tennis racket in an in-plane direction thereof as well as in an out-of-plane direction thereof to allow impacts to be applied to a tennis player's arm to a lesser extent when the tennis player hits a ball therewith and allow the tennis player to feel comfortable throughout the hand and arm holding the racket.

In order to achieve these objects, there is provided a tennis racket having a vibration damping member provided in the vicinity of a position of a racket frame at which a large amplitude is generated when the tennis racket hits a tennis ball. The vibration damping member includes a mass adding part having a portion extending in a widthwise direction of the tennis racket an in-plane direction and a portion extending in a thickness direction thereof out-of-plane direction such that the both portions are integral with each other. Or a mass adding part having a portion extending in a widthwise direction of the tennis racket and a portion extending in a thickness direction thereof such that the both portions are unintegral with each other may also be provided. An elastic connecting part such as a viscoelastic material, a spring; or/and a damper each for connecting the mass adding part to the racket frame is provided. Each of the viscoelastic material, the spring, or/and the damper has a widthwise connection portion for connecting the widthwise portion of the mass adding part and the racket frame with each other and a thickness direction connection portion for connecting both sides of the thickness direction portion of the mass adding part and the racket frame with each other. The vibration damping member absorbs a vibration in the widthwise direction (in plane vibrations) of the racket frame, a vibration in the thickness direction thereof (out-of-plane vibrations), a vibration and an impact generated by a linear movement of a grip and a rotation thereof.

As described above, the vibration damping member to be installed on the racket frame consumes the vibration energy of the tennis racket increasingly as the amplitude thereof becomes greater. Thus, the mass adding part is combined with the viscoelastic material, the spring, or/and the damper. The mass adding part has the widthwise portion and the thickness direction portion. As described above, the widthwise portion and the thickness direction portion are installed on the racket frame through the elastic connecting part such as viscoelastic material and the like. That is, the widthwise connection portion and the thickness direction connection portion of each of the elastic connecting part such as the viscoelastic material, the spring, or/and the damper are separate from each other.

The shape and material of the mass adding part and the elastic connecting part may vary, provided that the vibration damping member has the above-described construction. But it is preferable that the mass adding part and the elastic connecting part are so shaped that they vibrate easily in both the out-of-plane and in-plane directions, do not prevent a player's motion, and do not interfere with a gut-installing work. It is also preferable that the vibration dumping member is small in view of the appearance of the tennis racket.

As described above, the mass adding part of the vibration damping member has the widthwise portion and the thickness direction portion which are installed on the racket frame through the viscoelastic material, the spring, or/and the damper. Thus, upon generation of vibrations of the racket frame in the in-plane direction, the viscoelastic material, the spring, or/and the damper vibrate greatly, thereafter, a mass adding part in the in-plane direction (widthwise) is vibrated. The start timing of the vibration of the vibration damping member in the in-plane direction is earlier than that of the vibration of the racket frame in the in-plane direction. That is, the vibration damping member consumes the frame-vibrating energy, thus damping the in-plane direction vibration of the racket frame rapidly. At this time, the viscoelastic portion, the spring, or the damper, and the mass adding part provided in the out-of-plane direction vibrate in the out-of-plane direction. Therefore, it is possible to damp the vibration both in the in-plane direction and the out-of-plane direction at the same time. Consequently, it is possible to greatly reduce impacts to be applied to the player and vibrations to be transmitted thereto.

More specifically, the mass adding part of the vibration damping member may be U-shaped, rectangular or L-shaped in section such that the widthwise portion thereof and the thickness direction portion thereof are either integral or unintegral with each other. In a thickness direction and a widthwise direction, the mass adding part (a bracket assembly in most embodiments) is installed on an outer surface or an inner surface of a gut-installing part surrounding a face part (the racket head) of the racket frame or/and a throat part thereof through the elastic connecting part such as viscoelastic material, the spring, or/and the damper. Alternatively, the mass adding part having a predetermined shape is installed inside a hollow portion of the racket frame in a thickness direction and a widthwise direction of the hollow portion, with the mass adding part surrounded with the elastic connecting part such as the viscoelastic material, the spring, or/and the damper.

It is preferable that the mass adding part of the vibration damping member is made of a material having a specific gravity of from 5 to 22, that the mass adding part is made of metal, that the viscoelastic material is made of rubber or resin, and that a 50%-viscoelastic modulus of the viscoelastic material is in the range of from 0.5 kgf/cm$^2$ to 200 kg/cm$^2$. The weight of the vibration damping member including the mass adding part and the viscoelastic material is favorably from 1 g to 20 g and more favorably from 1 g to 10 g.

That is, it is preferable that the mass adding part has a high specific gravity so that the vibration damping member does not limit prevent a player's motion during play. Thus, the specific gravity of the mass adding part is set to from 5 to 22 and favorably from 7 to 12.

In the case where a spring is used instead of the viscoelastic material or the spring and the viscoelastic material are used in combination, a metal spring, an air spring, or a spring made of resin can be used. As the metal spring, it is possible to use a coil spring, a leaf spring, a torsion bar, a belleville spring, a ring spring, a volute spring, and a spiral spring. In the case where the damper is used, the following dampers are used: a viscous oil damper, a magnetic damper, a mechanical snapper, a steel damper, a friction damper, a viscous damper, a viscoelastic damper, a wire rope damper, and an air damper.

It is possible to use only the viscoelastic material, only the spring or only the damper. It is also possible to use the viscoelastic material and the spring in combination; the viscoelastic material and the damper in combination; the spring and the damper in combination; or the viscoelastic material, the spring, and the damper in combination.

As described above, the weight of the entire vibration damping member is not less than 1 g and not more than 20 g and favorably, not less than 1 g and not more than 10 g. If the weight of the entire vibration damping member is less than 1 g, a vibration energy to be consumed by resonance is low. Thus, the vibration damping member does not provide its vibration damping effect. If the weight of the entire vibration damping member is more than 20 g, it is necessary to make the tennis racket heavy to allow the weight of the racket frame to balance with the weight of the vibration damping member, which makes the total weight of the tennis racket heavy, therefore, the tennis racket has a poor operability.

As the viscoelastic material of the vibration damping member, the following materials can be used: natural resin such as natural rubber; synthetic resin such as polyvinyl chloride, polyurethane resin, polyamide resin, polystyrene resin, ethylene-vinyl acetate copolymer, ethylene ethyl acrylate resin, polyolefin resin, polyester resin, epoxy resin, phenol resin, fluoroplastics, urea resin; synthetic rubber such as styrene-butadiene rubber, nitrile rubber, chloroprene rubber, isoprene rubber, butadiene rubber, butyl rubber, ethylene-propylene rubber, acrylic rubber, silicone rubber, thiol rubber, chlorinated rubber, and fluororubber. It is preferable to select materials whose viscoelastic module change in a small extent for a temperature change. Thus, it is preferable to use the polyester resin, the epoxy resin, the phenol resin, the fluoroplastics, the acrylic rubber, the silicone rubber, the fluororubber; or foams of these materials.

The vibration of the elastic connecting part is required to be accompanied with the vibration of the racket frame. Thus, at 50% modulus, the elastic modulus of the viscoelastic material is required to be not less than 0.5 kg/cm$^2$ and not more than 200 kg/cm$^2$ and favorably, not less than 1 kg/cm$^2$ and not more than 50 kg/cm$^2$.

The elastic modulus is measured in conformity to the method of physically examining vulcanized rubber specified by JIS K-6B01. That is, test piece shaped into a No. 3 type dumbbell is used. The load of the test piece is measured when the test piece is elongated by 50%. A 50% modulus (stress) M50 is calculated by using an equation (1) shown below:

$$M50=Fn/A \quad \text{(Equation 1)}$$

Where M50: stress (kgf/cm$^2$) at 50% elongation

Fn: load (kgf) at 50% elongation

A: sectional area (cm$^2$) of test piece

Further, in the present invention, there is provided a tennis racket in which a vibration damping member is provided in the neighborhood of a position of a maximum amplitude of in-plane and out-of-plane vibrations which are generated on a racket frame when a ball is hit with the tennis racket. The vibration damping member comprises a mass adding part; a elastic connecting part interposed between the mass adding part and the racket frame, such as viscoelastic material, a spring, or/and a damper. In selecting a kind of the mass adding part, the elastic connecting part such as viscoelastic material, the spring, or/and the damper; an elastic modulus of the viscoelastic material and the spring; a damping ratio of the damper; and a weight distribution ratio among the mass adding part, the viscoelastic material, the spring, or/and the damper, a resonance frequency of the vibration damping member is set in correspondence to the neighborhood of a frequency which is generated at the position of the tennis racket frame provided with the vibration damping member. Thereby, a vibration of the racket frame by a resonance of the vibration damping member and the racket frame is damped.

That is, the kind of the material of the mass adding part, the viscoelastic material, the spring, or/and the damper of the vibration damping member can be selected from the above-described materials. The elastic modulus of the viscoelastic material is selected from the above-described range (at 50% modulus, not less than 0.5 kg/cm$^2$ and not more than 200 kg/cm$^2$) . The weight distribution ratio among the mass adding part, the elastic connecting part such as viscoelastic material, the spring, or/and the damper is so selected that the total weight thereof is in the range of from 1 g to 20 g. By the selections, the resonance frequency of the vibration damping member is set in the neighborhood of the frequency generated at the position of the racket frame provided with the vibration damping member. In the case where the kind of the material, the weight, and the properties of the mass adding part, the viscoelastic material, the spring, or/and the damper of the vibration damping member are specified, the shape of the vibration damping member is not necessarily specified;

It is preferable that the location of the vibration damping member is installed on the gut-installing part surrounding a face part of the racket frame in the range from a position of two o'clock to a position of five o'clock and in the range from a position of seven o'clock to a position of 10 o'clock, supposing that the face part of the racket frame is regarded as a clock and that a top position of the face part is 12 o'clock.

When the vibration damping member is installed on the gut-installing part in the range from the position of two o'clock to the position of five o'clock and in the range from the position of seven o'clock to the position of 10 o'clock, it is installed at any one of the position of three o'clock and nine o'clock, the position of four o'clock and eight o'clock, the position of five o'clock and seven o'clock, or at all of the above positions. Alternatively, the long vibration damping member is prepared to install it in the range of the position from two o'clock to the position of five o'clock and in the range from the position of seven o'clock to the position of 10 o'clock.

At the position of five o'clock and that of seven o'clock, the in-plane and out-of-plane primary vibrations have a maximum amplitude. Therefore, by fixing the vibration damping member capable of suppressing the in-plane and out-of-plane vibrations to the position of five o'clock and seven o'clock, the vibrations can be effectively damped. It is preferable to set the elastic modulus or/and the damping ratio of the viscoelastic part, the spring or/and the damper in both the in-plane direction and the out-of-plane direction in correspondence to the in-plane frequency of the racket frame and the out-of-plane frequency thereof, respectively. The position of three o'clock and nine o'clock of the gut-installing part are the position of the maximum amplitude of the in-plane vibration which is generated on the face part of the tennis racket and also the position of the maximum amplitude of the out-of-plane secondary vibration. Therefore, the in-plane and out-of-plane vibrations can be effectively damped by fixing the vibration damping member to the position of three o'clock and nine o'clock. When the weight of the vibration damping member is set to less than 20 g and favorably to less than 10 g, the in-plane and out-of-plane vibrations can be effectively damped without adversely affecting the operability of the tennis racket by fixing the vibration damping member such that the vibration damping member is continuously located in the range from the position of two o'clock to the position of five o'clock and over the range from the position of seven o'clock to the position of 10 o'clock.

When the vibration damping member is installed on the gut-installing part in the range from the position of two o'clock to the position of five o'clock and in the range from the position of seven o'clock to the position of 10 o'clock, a mass is applied to a wide portion of the gut-installing part. Thus, the moment of inertia on the grip is great, which provides the effect of restraining a rotation of the grip part when a player hits a ball with the tennis racket at a portion of the face part other than the center thereof. Accordingly, it is possible to apply an impact to the player's elbow in a lower extent. It is optimum to install the vibration damping member on the gut-installing part at the position of three o'clock and the position of nine o'clock thereof.

The installing position of the vibration damping member is not limited to the range from two o'clock to five o'clock and the range from seven o'clock to 10 o'clock, but may be at any one of the position of 12 o'clock, the right and left throat parts, three o'clock and nine o'clock, the position of four o'clock and eight o'clock, the position of five o'clock and seven o'clock or at a plurality of these positions.

That is, when the vibration damping member is mounted on the throat part of the racket frame, the balance of the tennis racket is at the grip side. Thus, the operability of the tennis racket is high. The mounting of the vibration damping member on the top portion of the gut-installing part causes the balance of the tennis by racket to be at the top portion side, which is preferable for a tennis racket intended to be very lightweight and top-balanced.

In the case where a plurality of the vibration damping members are mounted on the gut-installing part, the weight of each vibration damping member is so adjusted that the total weight thereof is less than 20 g and preferably less than 10 g.

When the vibration damping member is installed on only the grip end of the tennis racket as in the case of the conventional tennis racket, the vibration damping member is not effective for damping vibration in the in-plane direction but increases the total weight of the racket frame.

DETAILED DESCRIPTION OF THE PREFERRED EMBODIMENTS

The embodiments of the present invention will be described below with reference to the drawings.

Figure 1:
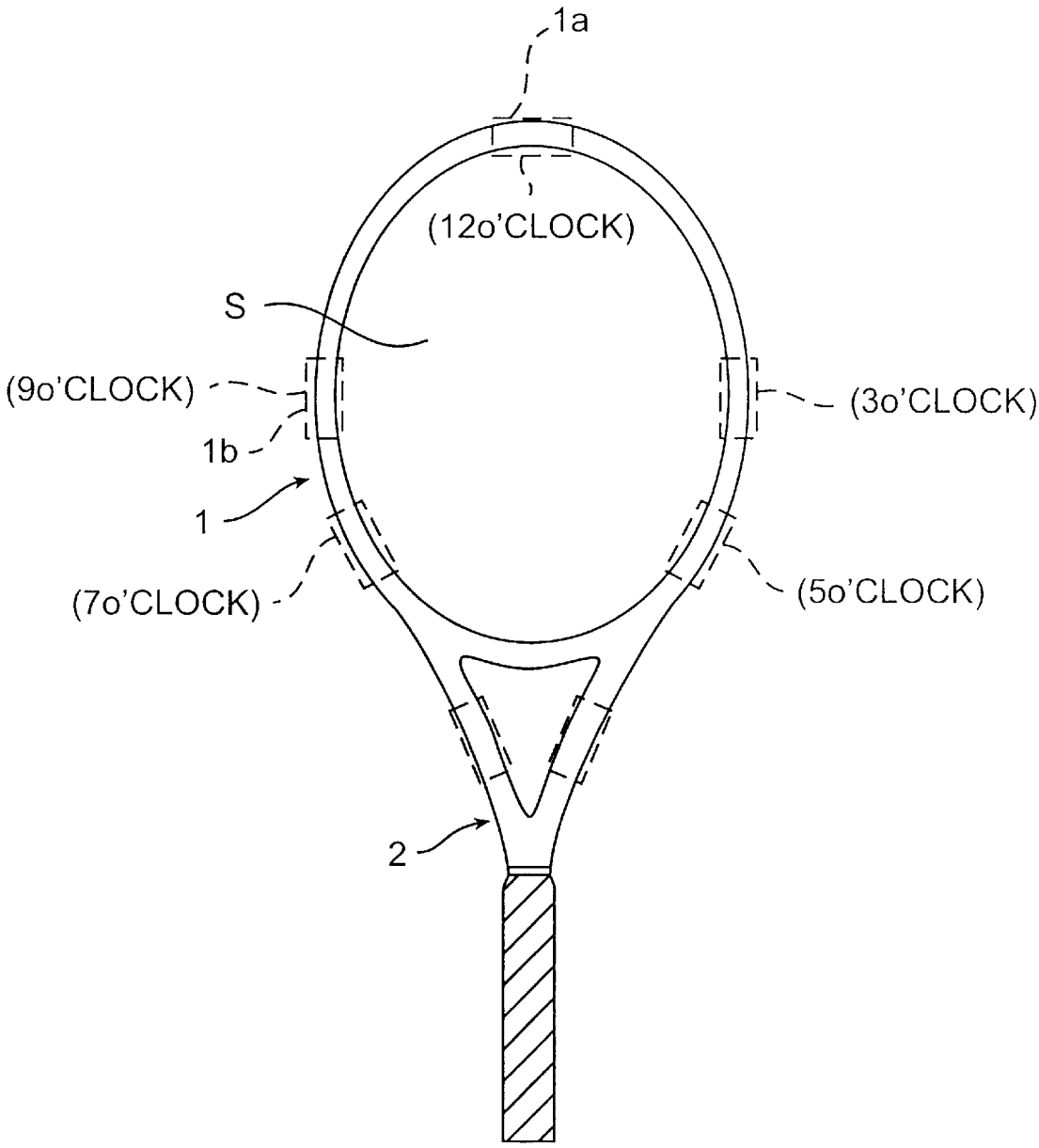
FIG. 1 is a plan view showing a racket frame according to an embodiment of the present invention.

FIG. 1 shows the shape of a tennis racket of the embodiment and that of a tennis racket of comparison examples prepared to compare the performances of both of the former and the latter with each other.

FIG. 1 is a plan view showing a streamline racket frame. In the gut-installing part 1 surrounding a face part S, the thickness from a top part la to a portion 1*b* of three o'clock and nine o'clock is 37 mm. The width of the gut-installing part 1 is maximum at the portion of three o'clock and nine o'clock. The thickness of a throat part 2 is 26 mm. The thickness of the gut-installing part 1 decreases gradually from the position of three o'clock and nine o'clock having the thickness 37 mm to the throat part 2 having the thickness 26 mm. The width of the gut-installing part 1 and that of the throat part 2 are 12 mm, respectively. The weight of the tennis racket is 266 g, supposing that gut is not installed on the face part S. A balance point P is located at 362 mm from the grip end. The racket frame is made of fiber-reinforced resin and hollow. Epoxy resin is used as matrix resin. Carbon fiber is used as reinforcing fiber. The specific gravity of the racket frame is from 1.3 to 1.6. The composition of the racket frame is not limited to the above-described one.

Figure 2A:
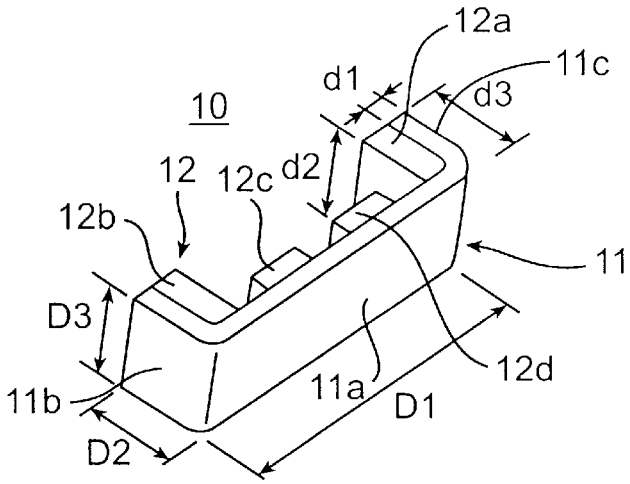
FIG. 2(A) is a perspective view showing a vibration damping member, according to a first embodiment, which is to be installed on the racket frame.

As shown in FIG. 2(A), a vibration damping member 10 to be installed on the racket frame includes a mass adding part 11, such as a bracket assembly, and a viscoelastic part 12 of a viscoelastic material. The mass adding part 11 is made of a metal sheet having a thickness of 0.5 mm and bent to be similar to the shape of "U" in section. The length D1 of a thickness direction portion 11*a* which is a connection portion of the U-shaped mass adding part 11 is set to a length equal to a length obtained by adding 10 mm to the thickness of the racket frame on which the vibration damping member 10 is to be installed. The width D2 of each of width direction portions 11*b* and 11*c* which is a pair of side surfaces of the U-shaped mass adding part 11 is 1 mm. The height D3 of the mass adding part 11 is 10 mm. The specific gravity of the mass adding part 11 is 11.3.

The mass adding part 11 is formed of a material having a high specific gravity. As the material of the mass adding part 11, a combination of an aluminum sheet and an iron plate, an aluminum sheet and a zinc sheet or a copper sheet and an iron sheet is used by bonding them to each other. The range of the specific gravity of the mass adding part 11 is from 5 to 22 and preferably from 7 to 12. Thus, when a length (D1+D2×2), namely, the addition of the thickness direction portion 11*a* and both width direction portions 11*b* and 11*c* is 47 mm, the mass adding part 11 is formed of an iron sheet and a zinc sheet bonded to each other to set the average specific gravity of the mass adding part 11 to 10.6.

Viscoelastic portions 12*a* and 12*b* to be used to connect the vibration damping member 10 to the racket frame in its widthwise direction are bonded to the width direction portions 11*b* and 11*c*, respectively of the mass adding part 11 with an adhesive agent. Each of the viscoelastic portions 12*a* and 12*b* has a thickness d1 of 5 mm, a height d2 of 10 mm, and a width d3 of 1 mm. With an adhesive agent, viscoelastic materials 12*c* and 12d to be used to connect the vibration damping member 10 to the racket frame in its thickness direction are bonded to an inner surface of the thickness direction portion 11*a* of the mass adding part 11 with a predetermined gap formed therebetween. Each of the viscoelastic materials 12*c* and 12*d* has a thickness of 5 mm, a height d2' of 10 mm, and a width of 5 mm. The four viscoelastic materials 12*a*–12*d* are formed separately from one another. The kind and viscoelastic module of the viscoelastic part 12 of examples and comparison examples which will be described below are differentiated from one another.

Figure 2B:
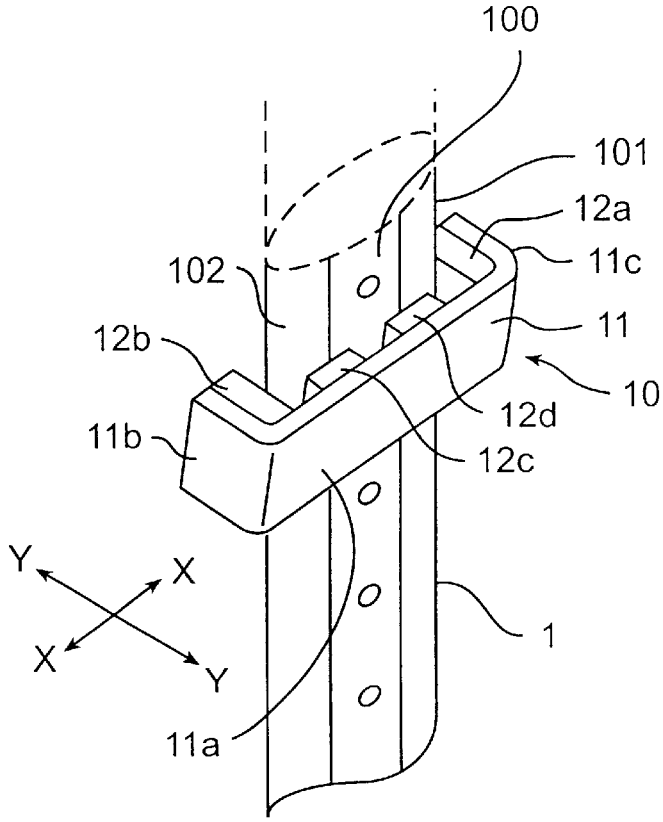
FIG. 2(B) is a perspective view showing a state in which the vibration damping member is installed on the racket frame.

As shown in FIG. 2(B), the vibration damping member 10 including the mass adding part 11 and the viscoelastic part 12 (12*a*–12*d*) is installed on an outer surface of the gut-installing part 1 of the racket frame. The viscoelastic portions 12*c* and 12*d* bonded to the thickness direction portion 11*a* of the mass adding part 11 are bonded to a thickness direction surface 100 of the gut-installing part 1 with an adhesive agent. The viscoelastic parts 12*a* and 12*b* bonded to the widthwise portions 11*b* and 11*c* of the mass adding part 11, respectively are bonded to both widthwise surfaces 101 and 102 of the gut-installing part 1 with an adhesive agent.

As shown in FIG. 2(B), in a thickness direction X, out-of-plane vibrations are generated on the racket frame when the racket frame hits a tennis ball, whereas in a widthwise direction Y, in-plane vibrations are generated on the racket frame when the racket frame hits the tennis ball.

The portion of installing the vibration damping member 10 is not limited to the gut-installing part 1 at the outer side thereof but may be installed on right and left throat parts 2, as will be described later. Further, the vibration damping member 10 and the right and left throat parts 2 may be installed on the inner surface of the gut-installing part 1. Further, the viscoelastic material 12 may be bonded to the periphery of the mass adding part 11, and the vibration damping member 10 may be embedded in a hollow part of the racket frame.

FIRST EXAMPLE

As the viscoelastic part 12 of the vibration damping member 10, a mixture of 30 parts by weight of natural rubber and 70 parts by weight of SBR100 (styrene-butadiene rubber) was used. The mixture was foamed twice in volume. The viscoelastic modulus 50% of the viscoelastic part 12 was 0.55 kgf/cm$^2$. The total weight of the vibration damping member 10, namely, the total of the weight (4.25 g) of the mass adding part 11 made of iron and zinc sheets and the weight of the viscoelastic part 12 was adjusted to 5 g. The vibration damping member 10 having the weight of 5 g was bonded to the gut-installing part 1 of the tennis racket at a portion (350 mm from the grip end) of five o'clock and a position of seven o'clock. That is, the vibration damping member 10 having the total weight of 10 g was installed on the racket frame.

SECOND EXAMPLE

As the viscoelastic part 12 of the vibration damping material 10, SBR100 (styrene-butadiene rubber) was used. The viscoelastic modulus 50% of the viscoelastic part 12 was 6.53 kgf/cm$^2$. The total weight of the vibration damping member 10, namely, the total of the weight (3.59 g) of the mass adding part 11 made of iron and zinc sheets and the weight of the viscoelastic part 12 was adjusted to 5 g. The vibration damping member 10 was bonded to the gut-installing part 1 at a portion (500 mm from the grip end) of three o'clock and a position of nine o'clock.

THIRD EXAMPLE

As the viscoelastic part 12 of the vibration damping member 10, silicone rubber was used. The viscoelastic modulus 50% of the viscoelastic part 12 was 11.7 kgf/cm$^2$. The total weight of the vibration damping member 10, namely, the total of the weight (3.35 g) of the mass adding part 11 made of a zinc sheet and the weight of the viscoelastic part 12 was adjusted to 5 g. The vibration damping member 10 was bonded to the gut-installing part 1 at the portion (500 mm from the grip end) of three o'clock and the position of nine o'clock.

FOURTH EXAMPLE

As the viscoelastic part 12 of the vibration damping member 10, silicone rubber was used. The viscoelastic modulus 50% of the viscoelastic part 12 was 11.7 kgf/cm$^2$. The total weight of the vibration damping member 10, namely, the total of the weight (3.35 g) of the mass adding part 11 made of a zinc sheet and the weight of the viscoelastic part 12 was adjusted to 5 g. The vibration damping member 10 was bonded to the gut-installing part 1 at the portion (350 mm from the grip end) of five o'clock and the position of seven o'clock.

FIFTH EXAMPLE

As the viscoelastic part 12 of the vibration damping member 10, silicone rubber was used. The viscoelastic modulus 50% of the viscoelastic part 12 was 11.7 kgf/cm$^2$. The total weight of the vibration damping member 10, namely, the total of the weight (3.35 g) of the mass adding part 11 made of a zinc sheet and the weight of the viscoelastic part 12 was adjusted to 5 g. The vibration damping member 10 was bonded to right and left throat parts (280 mm from the grip end).

SIXTH EXAMPLE

As the viscoelastic part 12 of the vibration damping member 10, silicone rubber was used. The viscoelastic modulus 50% of the viscoelastic part 12 was 11.7 kgf/cm$^2$. The total weight of the vibration damping member 10, namely, the total of the weight (3.35 g) of the mass adding part 11 made of a zinc sheet and the weight of the viscoelastic part 12 was adjusted to 5 g. Two vibration damping members 10 were bonded to a top part 1*a* of the gut-installing part 1.

SEVENTH EXAMPLE

A material used as the viscoelastic part 12 of the vibration damping member 10 was a mixture of 30 parts by weight of natural rubber and 70 parts by weight of SBR100 (styrene-butadiene rubber). The mixture was foamed twice in volume. The viscoelastic modulus 50% of the viscoelastic part 12 was 0.55 kgf/cm$^2$. The total weight of the vibration damping member 10, namely, the total of the weight (4.25 g) of the mass adding part 11 made of iron and zinc sheets and the weight of the viscoelastic part 12 was adjusted to 5 g. The vibration damping member 10 having the weight of 5 g was bonded to the gut-installing part 1 of the tennis racket at the position of three o'clock, nine o'clock, five o'clock, and seven o'clock.

Figure 3A:
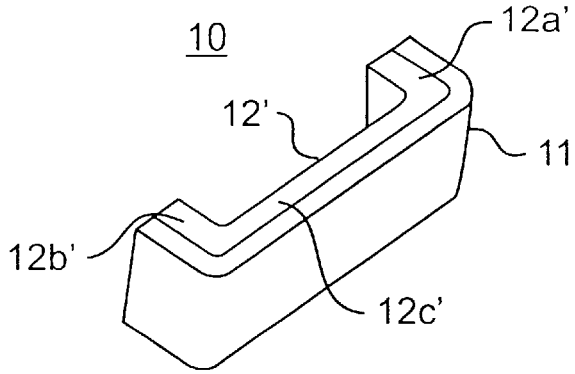
FIG. 3(A) is a perspective view showing a vibration damping member according to a second embodiment of the present invention.
Figure 3B:
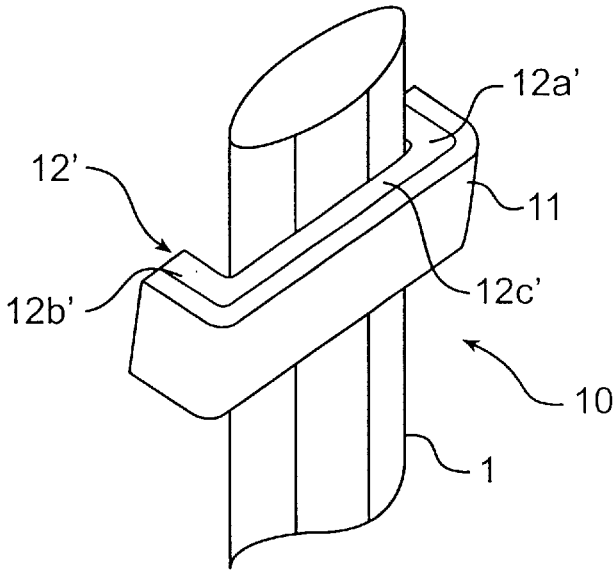
FIG. 3(B) is a perspective view showing a state in which the vibration damping member is installed on a racket frame.

FIGS. 3(A) and 3(B) show an eighth example of the present invention. In the first embodiment, the viscoelastic part of the viscoelastic material for connecting the vibration damping member to the racket frame in its widthwise direction is provided separately from the viscoelastic part for connecting the vibration damping member to the racket frame in its thickness direction. In the eighth example, the viscoelastic material 10 is constructed as one piece. More specifically, a one-piece viscoelastic part 12' approximately U-shaped in section is bonded to the inner surface of a mass adding part 11 approximately U-shaped in section. The widthwise surface of the mass adding part 11 is connected to the racket frame with viscoelastic portions 12*a*' and 12*b*' and the thickness direction surface of the mass adding part 11 is connected to the racket frame with a viscoelastic portion 12*c*'.

EIGHTH EXAMPLE

As the viscoelastic part 12 of the vibration damping member 10, silicone rubber whose viscoelastic modulus 50% was 11.7 kgf/cm$^2$ was used. The total weight of the vibration damping member 10, namely, the total of the weight (3.35 g) of the mass adding part 11 made of a zinc sheet and the weight of the viscoelastic part 12 was adjusted to 5 g. The vibration damping member 10 was bonded to the gut-installing part 1 at the portion (350 mm from the grip end) of five o'clock and seven o'clock of the gut-installing part 1.

Figure 4A:
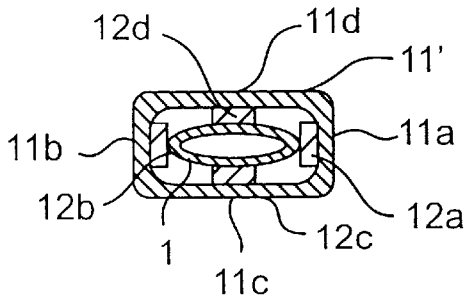
FIGS. 4(A), (B), (C), and (D) are sectional views showing modifications of a mass adding part of a vibration damping member.

The shape of the vibration damping member of the present invention is not limited to the shape of U in section. As shown in FIG. 4(A), a sectionally rectangular mass adding part 11' may be formed. The mass adding part 11' is connected with the racket frame 1 by connecting width direction portions 11*a*' and 11*b*' to the racket frame 1 through viscoelastic portions 12*a* and 12*b* and by connecting thickness direction portions 11*a*' and 11*b*' to the racket frame 1 through viscoelastic portions 12*c* and 12*d*.

Figure 4B:
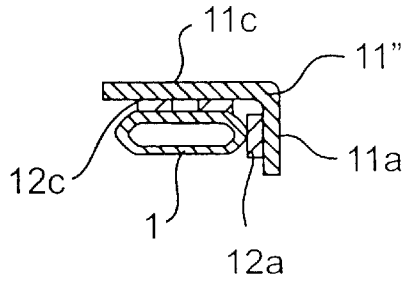

As shown in FIG. 4(B), a sectionally L-shaped mass adding part 11" may be formed. In this case, a width direction portion hla of the mass adding part 11" is connected with the racket frame 1 through a viscoelastic portion 12*a*, and a thickness direction portion 11*c* thereof is connected with the racket frame 1 through a viscoelastic portion 12*c*.

Figure 4C:
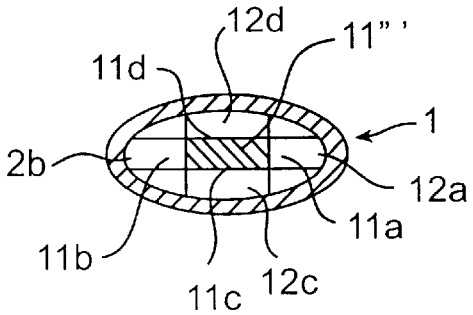

As shown in FIG. 4(C), a mass adding part 11"' may be embedded in a hollow part of the racket frame 1. In this case, width direction portions 11*a* and 1*b* of the mass adding part 11"' are connected with the racket frame 1 through viscoelastic portions 12*a* and 12*b*, and thickness direction portions 11*c* and 11*d* thereof are connected with the racket frame 1 through viscoelastic portions 12*c* and 12*d*.

Figure 4D:
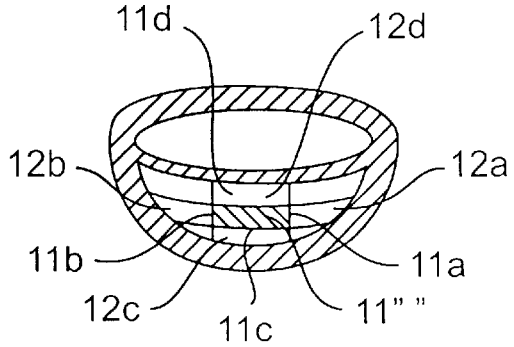

As shown in FIG. 4(D), a partitioning portion 1*d* is formed inside the racket frame 1 such that the partitioning portion 1*d* is integral with the racket frame 1 to form two hollow portions inside the racket frame 1. A vibration damping member 10"" is embedded inside one of the two hollow portions. In this case, widthwise portions 11*a* and 11*b* of a mass adding part 11"" are connected with the racket frame 1 through viscoelastic portions 12*a* and 12*b*, respectively and thickness direction portions 11*c* and 11*d* thereof are connected with the racket frame 1 through viscoelastic portions 12*c* and 12*d*, respectively.

NINTH EMBODIMENT

Figure 5:
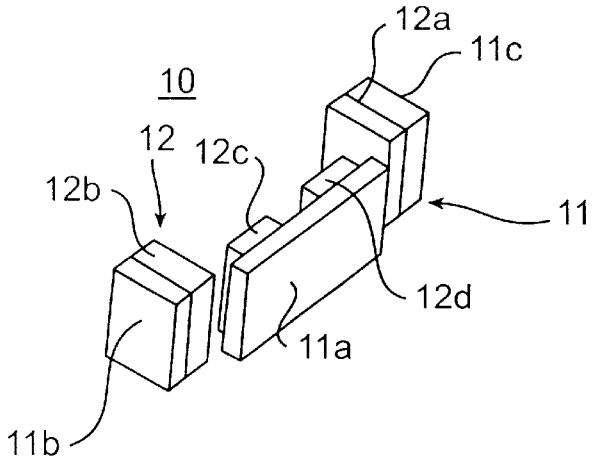
FIG. 5 is a perspective view showing a vibration damping member according to a ninth embodiment.

FIG. 5 shows a ninth example of the present invention. In the ninth embodiment, a thickness direction portion of the mass adding part 11 and a width direction portion thereof are not integral with each other, but the mass adding part 11 is constructed of three separate portions, namely, a thickness direction portion 11*a*, a widthwise portion 11*b*, and a widthwise portion 11*c*. Viscoelastic portions 12*c* and 12*d* are fixed to the inner surface of the thickness direction portion la with an adhesive agent, a viscoelastic portion 12*b* is fixed to the inner surface of the widthwise portion 11*b* with an adhesive agent, and a viscoelastic portion 12*a* is fixed to the inner surface of the widthwise portion 11*c* opposed to the widthwise portion 11*b* with an adhesive agent.

As the material of the viscoelastic part 12 (viscoelastic portions 12*a*–12*d*) of the vibration damping member 10, SBR100 (styrene-butadiene rubber) was used. The viscoelastic modulus 50% of the viscoelastic part 12 was 6.53 kgf/cm$^2$. The total weight of the vibration damping member 10, namely, the total of the weight of the mass adding part 11 (11*a*–11*c*) and the weight of the viscoelastic part 12 (12*a*–12*d*) was adjusted to 5 g. The vibration damping member 10 was bonded to the gut-installing part 1 at the portion (500 mm from the grip end) of three o'clock and nine o'clock.

Tennis rackets of first through sixth comparison examples were prepared to conduct comparison tests of vibration damping performance and impact absorption performance of the tennis rackets of the embodiments and the comparison examples.

FIRST COMPARISON EXAMPLE

The vibration damping member 10 was not installed on the racket frame of the first comparison example.

SECOND COMPARISON EXAMPLE

Figure 6:
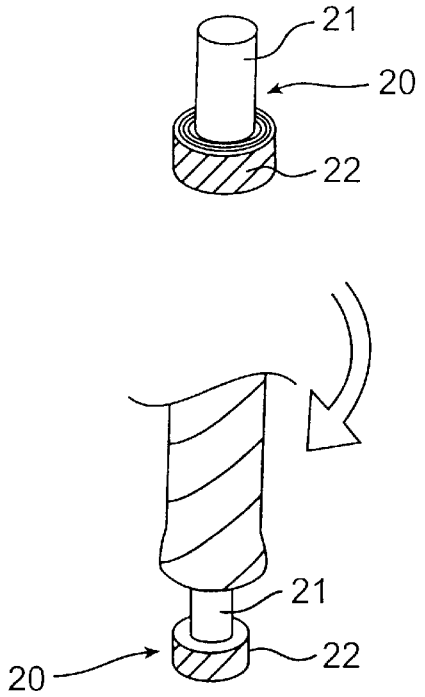
FIG. 6 PRIOR ART
FIG. 6 is a perspective view showing a vibration damping member of a comparison example.

A vibration damping member 20 having a shape as shown in FIG. 6 was installed at the grip end. That is, an iron sheet 22 was wound around a cylindrical polyurethane rubber 21 and bonded thereto. The total weight of the vibration damping member 20 was set to 10 g. The viscoelastic modulus 50% of the polyurethane rubber 21 was 10 kgf/cm$^2$.

THIRD COMPARISON EXAMPLE

Figure 7:
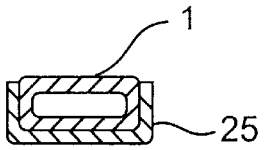
FIG. 7 PRIOR ART
FIG. 7 is a perspective view showing another vibration damping member of a comparison example.

A U-shaped weight 25 made of a zinc sheet (shown in FIG. 7) and having a weight of 5 g was fixed to the position of three o'clock and nine o'clock of a gut-installing part. That is, the vibration damping member of the third comparison example is different from the vibration damping member of the embodiments in that the vibration damping member of the former is not provided with the viscoelastic part.

FOURTH COMPARISON EXAMPLE

The U-shaped weight 25 made of a zinc sheet (shown in FIG. 7) and having a weight of 5 g was fixed to the position of five o'clock and seven o'clock of a gut-installing part.

FIFTH COMPARISON EXAMPLE

The U-shaped weight 25 made of a zinc sheet (shown in FIG. 7) and having a weight of 5 g was fixed to right and left throat parts.

SIXTH COMPARISON EXAMPLE

A U-shaped weight 25 made of a zinc sheet (shown in FIG. 7) and having a weight of 10 g was fixed to the top part of a gut-installing part.

EVALUATION TEST

Figure 8:
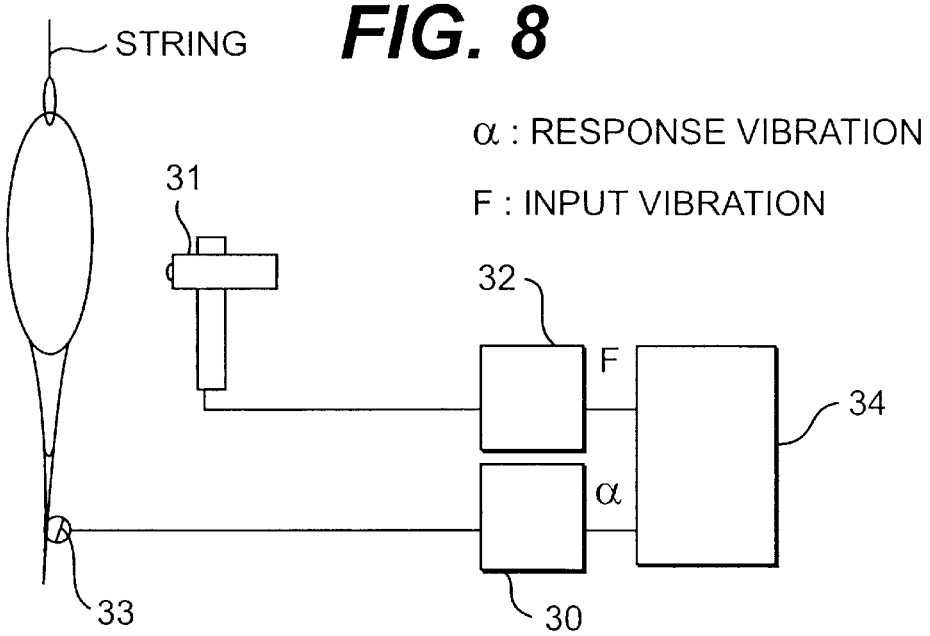
FIG. 8 is a schematic view showing a vibration-measuring device.
Figure 9C:
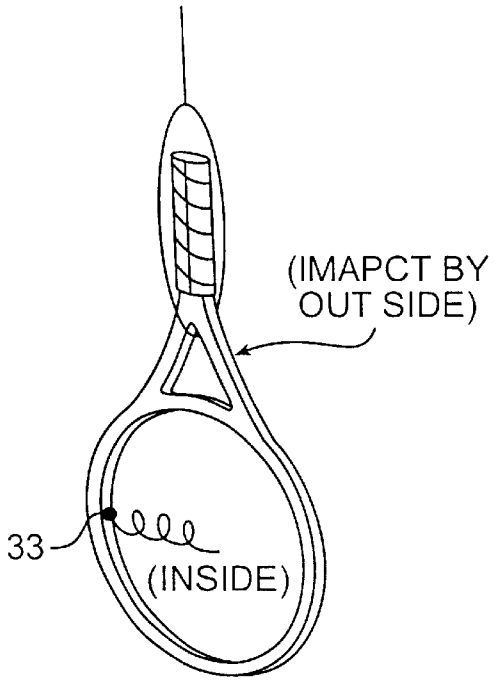
FIGS. 9(A), (B), and (C) show the vibration-measuring device.
Figure 9B:
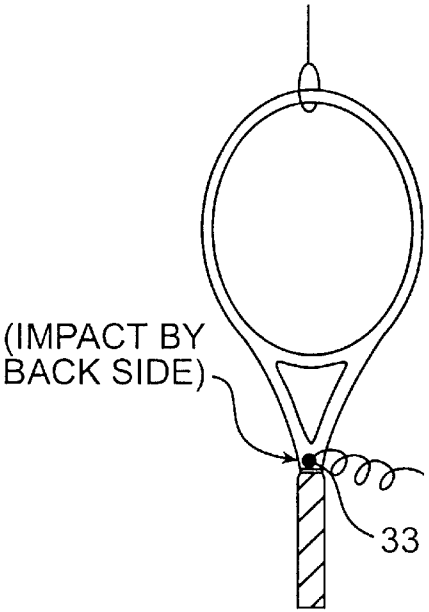
Figure 9A:
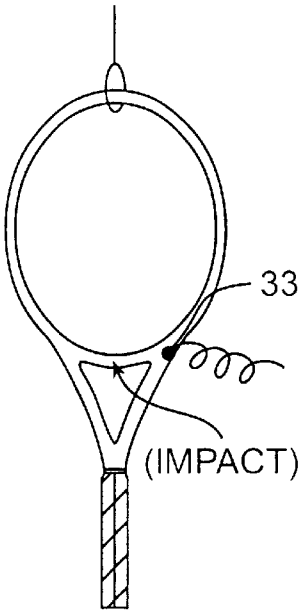

FIGS. 8, 9(A), and 9(B) show a method of measuring a inherent frequency of each tennis racket and a damping ratio thereof. For accurate measurement, an acceleration pick-up 33 is installed at a maximum amplitude position of each vibration mode, and each racket frame was impacted with an impact hammer 31 at the maximum amplitude position thereof. Gut was not installed on the face part of each tennis racket, but each tennis racket was hung with a string (free supporting method) . An input vibration (F) measured by a force pick-up installed on the impact hammer 31 and a response vibration ($\alpha$) measured by the acceleration pick-up 33 were analyzed by a frequency analysis device 34 (dynamic signal analyzer HP3562A, manufactured by HEWLETT PACKARD, LTD.) through amplifiers 32 and 30. The measuring method is carried out, assuming that the rigidity of the tennis racket is linear.

Figure 10:
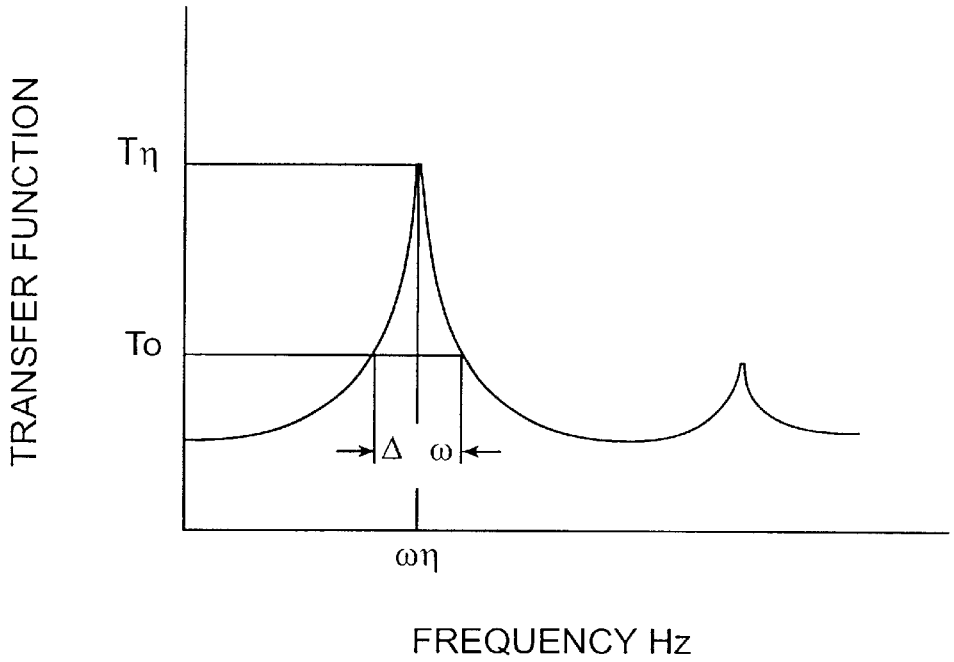
FIG. 10 is a diagram showing the relationship between a frequency and a transfer function.

A transfer function in a frequency region was determined in the above analysis to obtain an out-of-plane primary frequency of the racket frame, an out-of-plane secondary frequency thereof, and an in-plane frequency. The damping ratio ($\zeta$) was calculated, using an equation (2) shown below and based on FIG. 10.

$$\zeta=(1/2)\times(\Delta\omega/\omega n)\quad T0=Tn/\sqrt{2} \qquad \text{Equation 2}$$

Table 1 shows the result of the comparison test conducted on the tennis rackets of the first through ninth embodiments and first through sixth comparison examples.

TABLE 1

| | Out-of-Plane | | | | | |
|---|---|---|---|---|---|---|
| | Primary | | | Secondary | | |
| | Frequency (Hz) | Dumping Ratio (%) | Ratio to Comparison Example 1 | Frequency (Hz) | Dumping Ratio (%) | Ratio to Comparison Example 1 |
| Embodiment 1 | 163 | 4.695 | 7.3 | 442 | 0.800 | 1.3 |
| Embodiment 2 | 161 | 0.835 | 1.3 | 444 | 0.984 | 1.6 |
| Embodiment 3 | 163 | 0.793 | 1.2 | 397 | 2.817 | 4.6 |
| Embodiment 4 | 155 | 0.980 | 1.5 | 443 | 2.491 | 4.1 |
| Embodiment 5 | 159 | 0.906 | 1.4 | 436 | 1.638 | 2.7 |
| Embodiment 6 | 150 | 0.755 | 1.2 | 408 | 2.574 | 4.2 |
| Embodiment 7 | 146 | 5.447 | 8.4 | 460 | 2.444 | 4.0 |
| Embodiment 8 | 156 | 0.858 | 1.3 | 450 | 1.562 | 2.5 |
| Embodiment 9 | 163 | 0.801 | 1.2 | 400 | 3.100 | 5.0 |
| Comparison Example 1 | 160 | 0.645 | — | 448 | 0.615 | — |
| Comparison Example 2 | 150 | 2.012 | 3.1 | 438 | 0.688 | 1.1 |
| Comparison Example 3 | 160 | 0.800 | 1.2 | 429 | 0.836 | 1.4 |
| Comparison Example 4 | 157 | 0.787 | 1.2 | 447 | 1.421 | 2.3 |
| Comparison Example 5 | 159 | 0.813 | 1.3 | 444 | 1.494 | 2.4 |
| Comparison Example 6 | 153 | 0.716 | 1.1 | 438 | 0.781 | 1.3 |

| | In-Plane | | | | |
|---|---|---|---|---|---|
| | Frequency (Hz) | Dumping Ratio (%) | Ratio to Comparison Example 1 | Weight (g) | Balance (mm) |
| Embodiment 1 | 228 | 1.036 | 1.3 | 275 | 371 |
| Embodiment 2 | 225 | 6.768 | 8.5 | 274 | 375 |
| Embodiment 3 | 231 | 1.203 | 1.5 | 278 | 372 |
| Embodiment 4 | 230 | 1.044 | 1.3 | 276 | 370 |
| Embodiment 5 | 231 | 0.988 | 1.2 | 276 | 365 |
| Embodiment 6 | 222 | 0.952 | 1.2 | 277 | 377 |
| Embodiment 7 | 229 | 2.190 | 2.7 | 288 | 369 |
| Embodiment 8 | 230 | 0.964 | 1.2 | 278 | 371 |
| Embodiment 9 | 230 | 0.482 | 0.6 | 278 | 372 |
| Comparison Example 1 | 235 | 0.797 | — | 266 | 362 |
| Comparison Example 2 | 224 | 0.965 | 1.0 | 277 | 348 |
| Comparison Example 3 | 225 | 0.877 | 1.1 | 277 | 371 |
| Comparison Example 4 | 232 | 0.829 | 1.0 | 277 | 370 |
| Comparison Example 5 | 235 | 0.837 | 1.1 | 277 | 365 |
| Comparison Example 6 | 226 | 0.901 | 1.1 | 277 | 377 |

As shown in table 1, the damping ratio of the in-plane frequency of the tennis racket of each of the first through sixth embodiments is greater than that of the tennis racket of the first comparison example. The out-of-plane primary and secondary frequencies of the former are also higher tan than rat of the latter.

The out-of-plane primary and secondary frequency and the damping ratio of the tennis racket of each of the first through sixth embodiments are higher than that of the tennis racket of the first comparison example by not less than 1.2 times. Although the out-of-plane frequency of each of the third through fifth comparison examples is higher than that of the first comparison example by 1.2 or more, the in-plane frequency of each of the third through fifth comparison examples is higher than that of the first comparison example by 1.1 times or less. That is, the tennis rackets of the first through sixth embodiments are superior to that of the second comparison example because the damping ratio of the out-of-plane and in-plane frequencies of the tennis rackets of the first through sixth embodiments are higher than that of the out-of-plane and in-plane frequencies of the second comparison example.

Similarly to the first and fourth embodiments and the fourth comparison example, in the tennis racket of the eighth embodiment, the vibration damping member was installed at the position of five o'clock and seven o'clock of the gut-installing part, and the thickness direction portion and the widthwise portion of the viscoelastic part were integral with each other. The damping ratio of the in-plane and out-of-plane frequencies of the tennis racket of the eighth embodiment were a little lower than that of the tennis racket of the first and fourth embodiments, but was a little higher than that of the tennis racket of the fourth comparison example That is, it was confirmed that the viscoelastic part having the thickness direction portion and the widthwise portion separate therefrom is more effective than that having the thickness direction portion and the widthwise portion integral therewith. Further, it was confirmed that the vibration damping member of the eighth embodiment was higher than that of the fourth comparison example in the vibration damping performance.

Because the vibration damping member of the tennis racket of the ninth embodiment had the thickness direction portion and the widthwise portion separate therefrom, it had a little higher vibration damping ratio than the vibration damping member of the tennis racket of the third embodiment having the thickness direction portion and the widthwise portion integral therewith.

Figure 11:
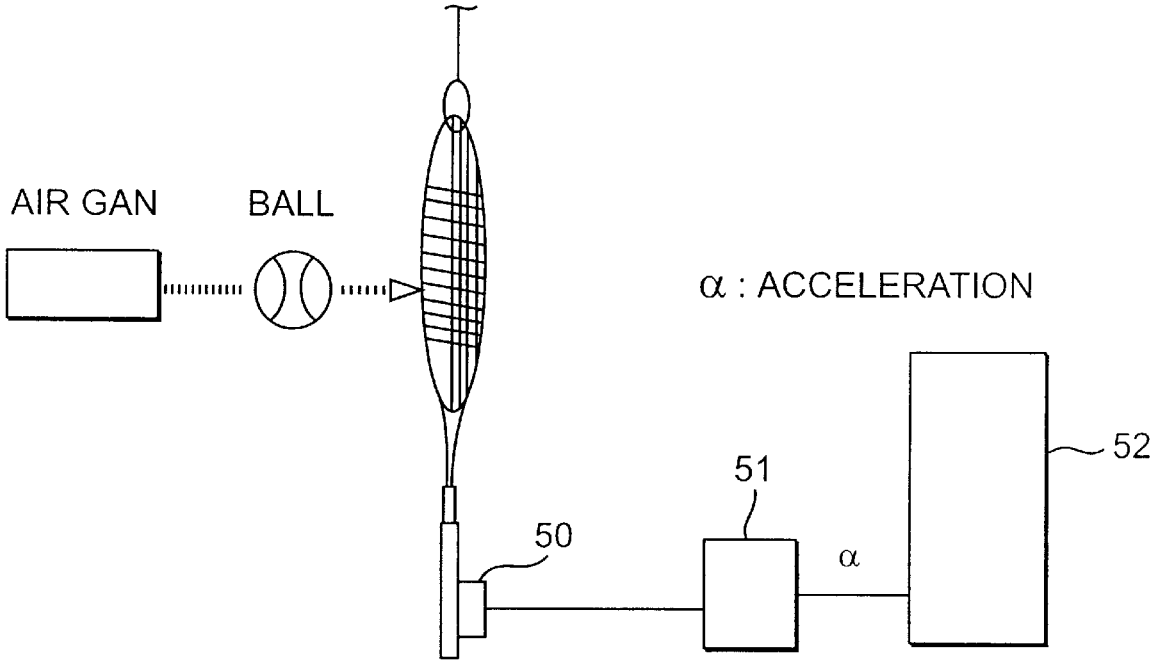
FIG. 11 is a schematic view showing an acceleration-measuring device.

To measure the magnitude of the impact force applied to the grip part to be held by a player, an acceleration of a ball which collided with the tennis racket of each of the first through ninth embodiments and first through sixth comparison examples was measured. In the measurement, each tennis racket was hung, with an accelerometer 50 bonded to a portion of the grip part 4cm apart from the grip end, as shown in FIG. 11. An amplifier 51 was connected with the accelerometer 50 and with a frequency analysis device (FET) 52. A ball collided with the center of the gut-installing part of each tennis racket at a speed of 30m/sec to measure the acceleration of the ball which collided therewith.

Figure 12:
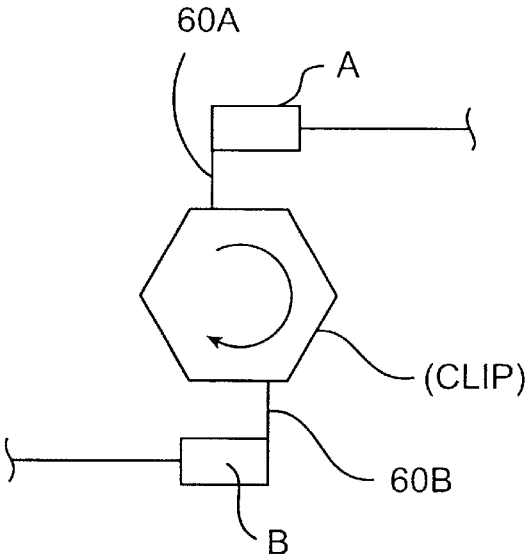
FIG. 12 is a schematic view showing a device for measuring the magnitude of an impact in a rotation direction of a tennis racket.
Figure 13:
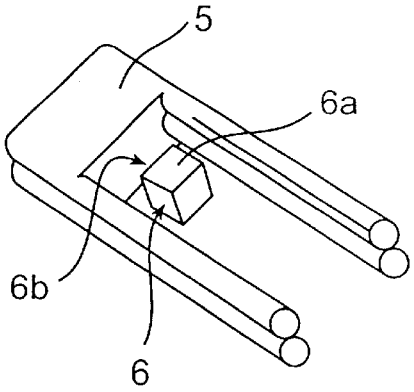
FIG. 13 PRIOR ART
FIG. 13 is a perspective view showing a conventional vibration damping member.
Figure 14:
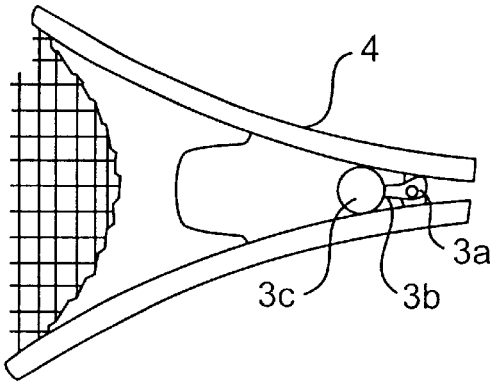
FIG. 14 PRIOR ART
FIG. 14 is a perspective view showing another conventional vibration damping member.
Figure 15:
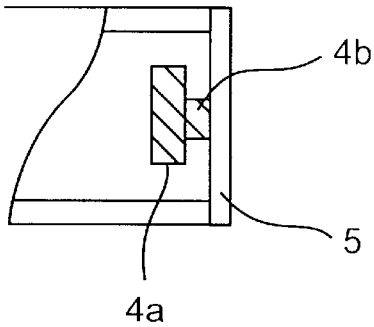
FIG. 15 PRIOR ART
FIG. 15 is a perspective view showing still another conventional vibration damping member.
Figure 16A:
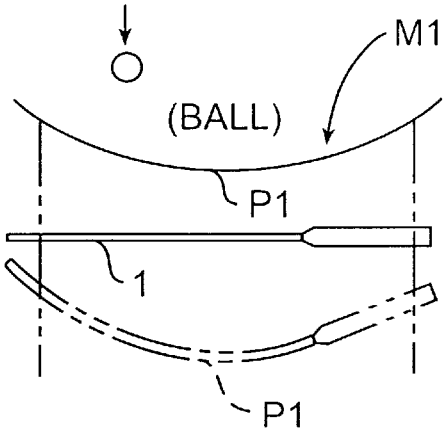
FIGS. 16(A) and 16 (B) show a deformation state generated by vibrations of a racket frame when a ball collides with a face part of the racket frame.
Figure 16B:
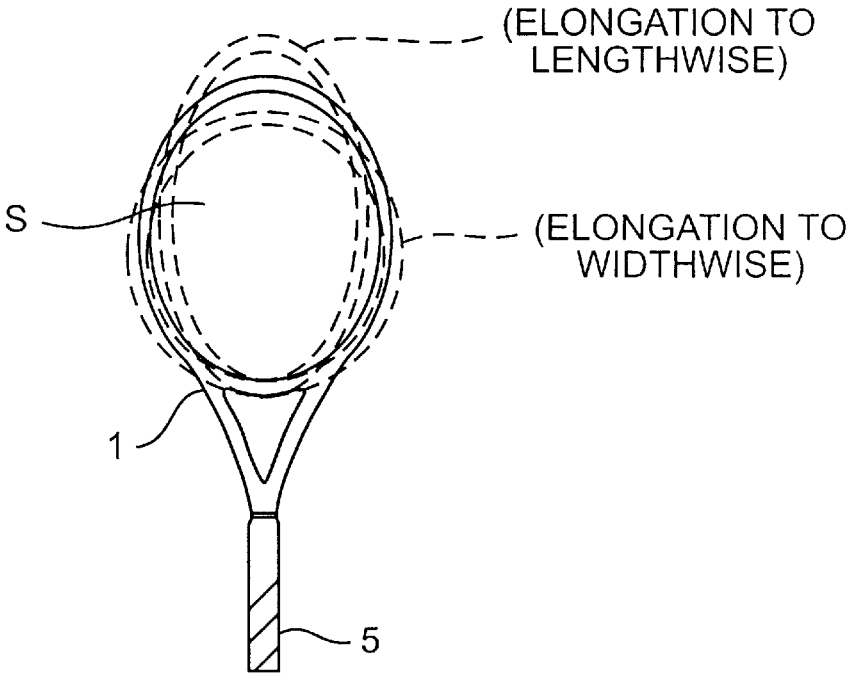

In the tennis racket of each of the first through ninth embodiments and first through sixth comparison examples, to measure the magnitude of an impact applied to the grip part of each tennis racket in a rotational direction thereof, a ball collided with a position 8cm apart from the center of the gut-installing part at a speed of 30m/sec. As shown in FIG. 12, values A and B of accelerometers installed on iron plates 60A and 60B connected to the grip of each tennis racket. Using an equation (3) shown below, the degrees of rotatableness were compared.

$$(A+B)/2=\text{acceleration (G) in rotation direction} \qquad \text{[Equation 3]}$$

A tennis racket which was not rotated easily on the grip part had a low acceleration obtained by a calculation made by using the equation (3).

Table 2 shows an acceleration (G) of each tennis racket in the case of center hitting and an acceleration (G) of each tennis racket in the case of side hitting.

TABLE 2

| | Acceleration (G) at center hitting | Acceleration (G) at side hitting |
|---|---|---|
| First Embodiment | 267 | 250 |
| Second Embodiment | 276 | 232 |
| Third Embodiment | 283 | 230 |
| Fourth Embodiment | 290 | 254 |
| Fifth Embodiment | 293 | 291 |
| Sixth Embodiment | 295 | 305 |
| Seventh Embodiment | 266 | 190 |
| Eighth Embodiment | 300 | 262 |
| Ninth Embodiment | 280 | 225 |
| First C.E. | 318 | 310 |
| Second C.E. | 303 | 309 |
| Third C.E. | 308 | 237 |

TABLE 2-continued

| | Acceleration (G) at center hitting | Acceleration (G) at side hitting |
|---|---|---|
| Fourth C.E. | 313 | 260 |
| Fifth C.E. | 303 | 293 |
| Sixth C.E. | 313 | 311 |

Where C.E. denotes comparison example.

Referring to table 2, it is preferable that the tennis rackets have low accelerations (G) in the center hitting and the side hitting. In the center hitting, each of the first through sixth comparison examples had an acceleration greater than 300, namely, from 303 to 318. It was confirmed that the first comparison example not having a vibration damping member had the greatest acceleration;. To the contrary, each of the first through ninth embodiment had an acceleration less than 300, namely, 266–300. The tennis rackets having the vibration damping member installed at the position of five o'clock and seven o'clock or three o'clock and nine o'clock of the gut-installing part had a high impact-absorbing performance, respectively. The tennis racket of the eighth embodiment having the viscoelastic part whose thickness direction portion and widthwise portion integral are integral with each other was the lowest of the tennis rackets of the first through eighth embodiments in the impact-absorbing performances thereof. It was confirmed that the vibration damping member having the viscoelastic part and the mass adding part constructed of a plurality of separate portions, respectively had a higher impact energy absorbing effect than the vibration damping member whose thickness direction portion and widthwise portion are integral with each other. Further, it was confirmed that the tennis racket having a one-piece viscoelastic part installed thereon was superior to the tennis rackets of the comparison examples not having a viscoelastic part installed thereon.

In the acceleration of a ball in the case of the side hitting, the acceleration (G) in rotational direction around the grip of the tennis racket having the vibration damping member installed at the position of three o'clock, was lower than that of having the vibration damping member installed at the position of five o'clock. Further, the acceleration (G) of the tennis racket having the vibration damping member installed at the position of five o'clock was lower than that of having the vibration damping member installed at the position of the throat part.

As apparent from the foregoing description, according to the present invention, the vibration damping member includes the mass adding part, and the elastic connecting part such as the viscoelastic material, the spring, or/and the damper. The mass adding part is installed on the racket frame through the mass adding part, the viscoelastic material, the spring, or/and the damper. The elastic connecting part such as the viscoelastic material and the like has the widthwise connection portion and the thickness direction connection portion. The widthwise connection portion and the thickness direction connection portion are mounted respectively on the widthwise portion and the thickness portion of racket frame. The vibration damping member having the construction provides the following operation and effect.

That is, upon generation of vibrations of the racket frame in the in-plane direction, the viscoelastic material, the spring, or/and the damper of the vibration damping member provided in the in-plane direction (widthwise) vibrate greatly. As a result, a mass adding part in the in-plane direction (widthwise) is vibrated. The vibration of the vibration damping member in the in-plane direction resonates with the vibration of the racket frame in the in-plane direction. Thus it is possible to damp the vibration of the racket frame rapidly. At this time, the viscoelastic portion, the spring, the damper, and the mass adding part provided in the out-of-plane direction vibrate in the out-of-plane direction. Therefore, it is possible to damp the vibration both in the in-plane direction and the out-of-plane direction at the same time. Consequently, it is possible to greatly reduce impacts and vibrations to be applied to a player.

By fixing the vibration damping member capable of suppressing the in-plane and out-of-plane vibrations to the position of five o'clock and seven o'clock of the gut-installing part at which the amplitude of the out-of-plane primary vibration is maximum, the vibrations can be effectively damped. The position of three o'clock and nine o'clock of the gut-installing part are the position of the maximum amplitude of the in-plane vibration which is generated on the face part of the tennis racket and also the position of the maximum amplitude of the out-of-plane secondary vibration. Therefore, the in-plane and out-of-plane vibrations can be effectively damped by fixing the vibration damping member to the position of three o'clock and nine o'clock. When the weight of the vibration damping member is adjusted to less than 20 g and favorably to less than 10 g, the in-plane and out-of-plane vibrations can be effectively damped by fixing the vibration damping member to the gut-installing part at the position of three o'clock and nine o'clock and the position of five o'clock and seven o'clock.

When the vibration damping member is installed on the gut-installing part in the range from the position of two o'clock to the position of five o'clock and in the range from the position of 10 o'clock to the position of seven o'clock, a load is applied to a wide portion of the gut-installing part. Thus, the moment of inertia on the grip is great, which provides the effect of restraining a rotation of the grip when a player hits a ball with the tennis racket at a portion of the face part other than the center thereof. Further, as the vibration damping member can absorb an impact to a high extent, it is possible to apply the impact to the player's elbow in a lower extent.

What is claimed is:

1. Apparatus for damping vibrations in a sports racket, said vibrations being generated by the striking of a ball with a head portion of the racket, said apparatus including at least one vibration damping member connected to a frame of the racket in at least one selected location, an improvement in the vibration damping member comprising:

first elastic damping material connectable to the racket frame for damping vibrations generated in said frame in a plane defined by a face of the head portion;

second elastic damping material connectable to the racket frame for damping vibrations in the racket frame transverse to said plane defined by the face of the head portion; and a mass adding member connectable to said first and second elastic damping members in order to vibrate freely independent of said racket frame;

whereby vibrations directed both in-plane and out-of-plane of the racket head are damped by the elastic material, as well as longitudinal and rotational vibrations in a handle portion of the racket.

2. The apparatus of claim 1, wherein said mass adding member includes:

a bracket assembly for adding mass and support to the first and second elastic damping materials, said bracket assembly including a portion extending in a widthwise direction of the head portion of the racket frame and a second portion extending in a thickness direction of the head portion;

said first elastic damping material being supported by the second portion of the bracket assembly; and said second elastic damping material being supported by the first portion of the bracket assembly.

3. The apparatus of claim 2, wherein the first elastic damping material is disposable between the second portion of the bracket assembly and the racket frame, and the second elastic damping material is disposable between the first portion of the bracket assembly and the racket frame.

4. The apparatus of claim 3, wherein said first and second elastic damping materials are separate from each other.

5. The apparatus of claim 4, wherein said bracket assembly is U-shaped in cross section; the first portion of the bracket assembly being formed by end segments of the U-shape, and the second portion of the bracket assembly forming a connecting segment between the end segments.

6. The apparatus of claim 4, wherein said bracket assembly is L-shaped in cross section; one segment of the L shape forming the first portion of the bracket assembly, and another segment forming the second section of the bracket assembly.

7. The apparatus of claim 6, wherein said bracket assembly includes separate first and second portions orthogonally disposed with respect to each other.

8. The apparatus of claim 1, further including a mass of a predetermined weight embedded in the racket frame in a region adjacent the first and second elastic damping materials.

9. The apparatus of claim 2, wherein each said vibration damping member is made of a material having a specific gravity of from 5 to 22; the elastic materials have a 50% modulus of elasticity in a range of from 0.5 $kgf/cm^2$ to 200 $kgf/cm^2$; and a combined weight of said bracket assembly and said elastic material is from 1 g to 20 g.

10. The apparatus of claim 1, wherein said vibration damping members are installed on said head portion of said racket at selected locations from a position of two o-clock to a position of five o-clock, and in a range from a position of seven o-clock to a position of 10 o'clock, supposing that said face part of said head portion is regarded as a clock and that a top position of said head portion is 12 o'clock.

11. The apparatus of claim 1, wherein said vibration damping members are installed on said head portion of said racket at any one of a position of three o'clock, five o'clock, nine o'clock, seven o'clock, 12 o'clock, right and left throat parts of the racket or at a plurality of said positions, supposing that said head portion of said racket frame is regarded as a clock and that a top position of said head portion is 12 o'clock.

12. The apparatus of claim 2, wherein characteristic parameters of the bracket assembly and elastic material for each vibration damping member are selected such that the elastic modulus of the elastic material, the damping ratio of the member, and the weight ratio of the bracket assembly to the elastic material are chosen corresponding to a frequency which is generated at vibration damping member-provided positions of said racket frame when a ball is hit with said racket, whereby a vibration of said racket frame by a resonance of said vibration damping member and said racket frame is damped.

13. The apparatus of claim 1, wherein the elastic materials are selected from a group of materials consisting essentially to viscoelastic material, mechanical springs, rubber, or resins.

14. The apparatus of claim 2, wherein the elastic materials are selected from a group of materials consisting essentially to viscoelastic material, mechanical springs, mechanical dampers, rubber, or resins.

15. The apparatus of claim 3, wherein the elastic materials are selected from a group of materials consisting essentially to viscoelastic material, mechanical springs, mechanical dampers, rubber, or resins.

16. The apparatus of claim 8, wherein the elastic materials are selected from a group of materials consisting essentially to viscoelastic material, mechanical springs, mechanical dampers, rubber, or resins.

17. The apparatus of claim 1, wherein said first and second elastic damping materials are selected to have resonant frequencies substantially corresponding to the resonant frequency of a portion of the racket frame to which the elastic damping materials are connected.

* * * * *

UNITED STATES PATENT AND TRADEMARK OFFICE

CERTIFICATE OF CORRECTION

PATENT NO. : 6,293,878 B1
DATED : September 25, 2001
INVENTOR(S) : Takuzo Iwatsubo et al.

It is certified that error appears in the above-identified patent and that said Letters Patent is hereby corrected as shown below:

Title page,
Item [73], Assignee, please correct the information to insert the second assignee's name as follows:
-- [73] Assignees: Sumitomo Rubber Industries, Ltd., and Takuzo Iwatsubo, both of Hyogo (JP). --

Signed and Sealed this

Twenty-third Day of April, 2002

*Attest:*

*Attesting Officer*

JAMES E. ROGAN
*Director of the United States Patent and Trademark Office*